US012509203B2

(12) United States Patent
Fujiwara et al.

(10) Patent No.: US 12,509,203 B2
(45) Date of Patent: Dec. 30, 2025

(54) ELECTRIC OUTBOARD MOTOR

(71) Applicant: HONDA MOTOR CO., LTD., Tokyo (JP)

(72) Inventors: Masato Fujiwara, Saitama (JP); Kota Nakamori, Saitama (JP); Tatsuya Shibuya, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 567 days.

(21) Appl. No.: 17/981,912

(22) Filed: Nov. 7, 2022

(65) Prior Publication Data

US 2023/0150633 A1 May 18, 2023

(30) Foreign Application Priority Data

Nov. 17, 2021 (JP) ..... 2021-187250

(51) Int. Cl.
*B63H 20/00* (2006.01)

(52) U.S. Cl.
CPC ..... *B63H 20/007* (2013.01)

(58) Field of Classification Search
CPC ..... B63H 20/007; B63H 20/32; B63H 20/36
See application file for complete search history.

(56) References Cited

U.S. PATENT DOCUMENTS 7,736,207 B2 * 6/2010 Vignau ..... B63H 20/36 440/77
8,134,639 B2 3/2012 Furuhashi et al.
2009/0017706 A1 1/2009 Vignau
2010/0230450 A1 9/2010 Tomberli
2013/0039766 A1 * 2/2013 Murikipudi ..... F04D 29/364 416/149

FOREIGN PATENT DOCUMENTS

| | | | |
|---|---|---|---|
| JP | H08214657 | A | 8/1996 |
| JP | 2005153727 | A | 6/2005 |
| JP | 2009253864 | A | 10/2009 |
| JP | 2011213215 | A | 10/2011 |
| JP | 2011213220 | A | 10/2011 |
| JP | 2013039890 | A | 2/2013 |
| KR | 20100007798 | U | 8/2010 |

OTHER PUBLICATIONS

Notice of Reasons for Refusal for Japanese Patent Application No. 2021-187250 dated Apr. 23, 2024; 8 pp.
Office Action for German Patent Application No. 102022129125.1, dated Jul. 9, 2025; 11 pp.
Search report for German Patent Application No. 102022129125.1, dated Jul. 9, 2025; 14 pp.

* cited by examiner

*Primary Examiner* — Anthony D Wiest
(74) *Attorney, Agent, or Firm* — Armstrong Teasdale LLP

(57) ABSTRACT

An electric outboard motor includes: an electric motor disposed in an upper portion; a propeller disposed in a lower portion; a drive shaft extending in an up-down direction to transmit rotation of the electric motor to the propeller; and a case including a case upper portion that houses the electric motor and a case lower portion that houses the drive shaft. The case upper portion includes a rearward extension that extends rearward relative to the case lower portion, and a shoulder pad member which is a member separate from the case is provided on a lower surface of the rearward extension.

8 Claims, 4 Drawing Sheets

ELECTRIC OUTBOARD MOTOR

TECHNICAL FIELD

The present invention relates to an electric outboard motor having an electric motor installed therein as a power source.

BACKGROUND ART

In recent years, electric outboard motors which are driven by an electric motor are attracting attention as they have little adverse effect on the global environment. In contrast to engine outboard motors, for example, the electric outboard motors discharge no exhaust gas into the water, and therefore, the electric outboard motors can reduce impact on the environment.

For example, JP2011-213220A discloses an electric outboard motor in which an electric motor is disposed to be vertically spaced from a gear case that accommodates gears for converting the output of the electric motor into an output in a direction to propel the hull. The electric outboard motor is mounted to the hull via a bracket device, and after the sailing ends, is removed from the hull to be stored in a storage location. In this electric outboard motor, a carrying handle is disposed between the electric motor and the gear case to improve the transportability of the electric outboard motor when the transporter (user) transports the electric outboard motor. The carrying handle is U-shaped and is disposed behind the swivel bracket. Thereby, when transporting the electric outboard motor with the longitudinal direction of the electric outboard motor being horizontal, the use can hold a part near the center of gravity of the electric outboard motor.

JP2013-39890A discloses an electric outboard motor in which the carrying handle to be used when transporting the electric outboard motor is fixed to a rear end portion of a lower surface of a lower housing of a driving electric motor and protrudes rearward from the driving electric motor. Namely, in this electric outboard motor, the carrying handle is provided in the vicinity of the driving electric motor which is the heaviest component of the outboard motor main body. The carrying handle has a substantially rectangular annular shape in plan view.

However, in the aforementioned conventional technologies, when transporting the electric outboard motor to the storage location or the like, it is necessary to lift the electric outboard motor by grasping the carrying handle with one hand. Therefore, the transport is difficult for a person with a weak grip.

SUMMARY OF THE INVENTION

In view of the foregoing background, an object of the present invention is to provide an electric outboard motor that can be transported easily even by a person with a weak grip.

To achieve the above object, one aspect of the present invention provides an electric outboard motor (1), comprising: an electric motor (8) disposed in an upper portion; a propeller (12) disposed in a lower portion; a drive shaft (9) extending in an up-down direction to transmit rotation of the electric motor to the propeller; and a case (7) including a case upper portion (19) that houses the electric motor and a case lower portion (20) that houses the drive shaft, wherein the case upper portion includes a rearward extension (34) that extends rearward relative to the case lower portion, and a shoulder pad member (35) which is a member separate from the case is provided on a lower surface (34*a*) of the rearward extension.

According to this aspect, when transporting the electric outboard motor, the user can lift the electric outboard motor by placing the case upper portion on the shoulder such that the shoulder pad member contacts the shoulder. Therefore, even if the user has a weak grip, the user can transport the electric outboard motor easily.

Preferably, the shoulder pad member has an elastic modulus smaller than that of the case.

According to this aspect, the shoulder hurts less while the user is lifting the electric outboard motor.

Preferably, the lower surface of the rearward extension is connected to a rear surface (20*a*) of the case lower portion via a curved surface (20*b*), and the shoulder pad member is provided to extend from the lower surface to the curved surface.

According to this aspect, when the electric outboard motor is swayed while the user is lifting the electric outboard motor, an impact applied from the electric outboard motor to the user is reduced.

Preferably, the shoulder pad member extends over a first dimension (D1) in the up-down direction and extends over a second dimension (D2) greater than the first dimension in a front-rear direction.

According to this aspect, since the shoulder pad member is longer in the front-rear direction than in the up-down direction, it is easy for the user to carry the electric outboard motor on the shoulder.

Preferably, the shoulder pad member extends to a rear end of the rearward extension.

According to this aspect, even if the electric outboard motor slides forward while the user is carrying the electric outboard motor on the shoulder, the case upper portion is prevented from being directly placed on the shoulder. Therefore, the user can lift the electric outboard motor stably.

Preferably, a grasping member (36) which is a member separate from the case is provided on a part of the case lower portion spaced downward from the case upper portion.

According to this aspect, when transporting the electric outboard motor, the user can grasp the grasping member with a hand. Therefore, the user can lift the electric outboard motor stably.

Preferably, the grasping member has an elastic modulus smaller than that of the case.

According to this aspect, it is easy for the user to grasp the grasping member. Also, the hand grasping the grasping member does not slip easily. Therefore, the user can lift the electric outboard motor stably.

Preferably, the grasping member is made of a sheet material provided along an outer surface of the case lower portion and has a surface formed with irregularities (36*a*).

According to this aspect, the hand grasping the grasping member does not slip easily. Therefore, the user can lift the electric outboard motor stably.

Preferably, the case lower portion has at least one of protruding portions (37) that protrude in a horizontal direction above and below the grasping member, respectively.

According to this aspect, the user can easily recognize the position of the grasping member. Also, if the hand grasping the grasping member slips, the hand is prevented from leaving from the grasping member.

Thus, according to an aspect of the present invention, an electric outboard motor that can be transported easily by a person with a weak grip can be provided.

DETAILED DESCRIPTION OF THE INVENTION

In the following, an embodiment of the present invention will be described in detail with reference to the drawings. In the following embodiment, terms indicating the directions such as front, rear, up, down, etc. are used on the basis of a use state in which an electric outboard motor 1 is mounted to a hull 2.

Figure 1:
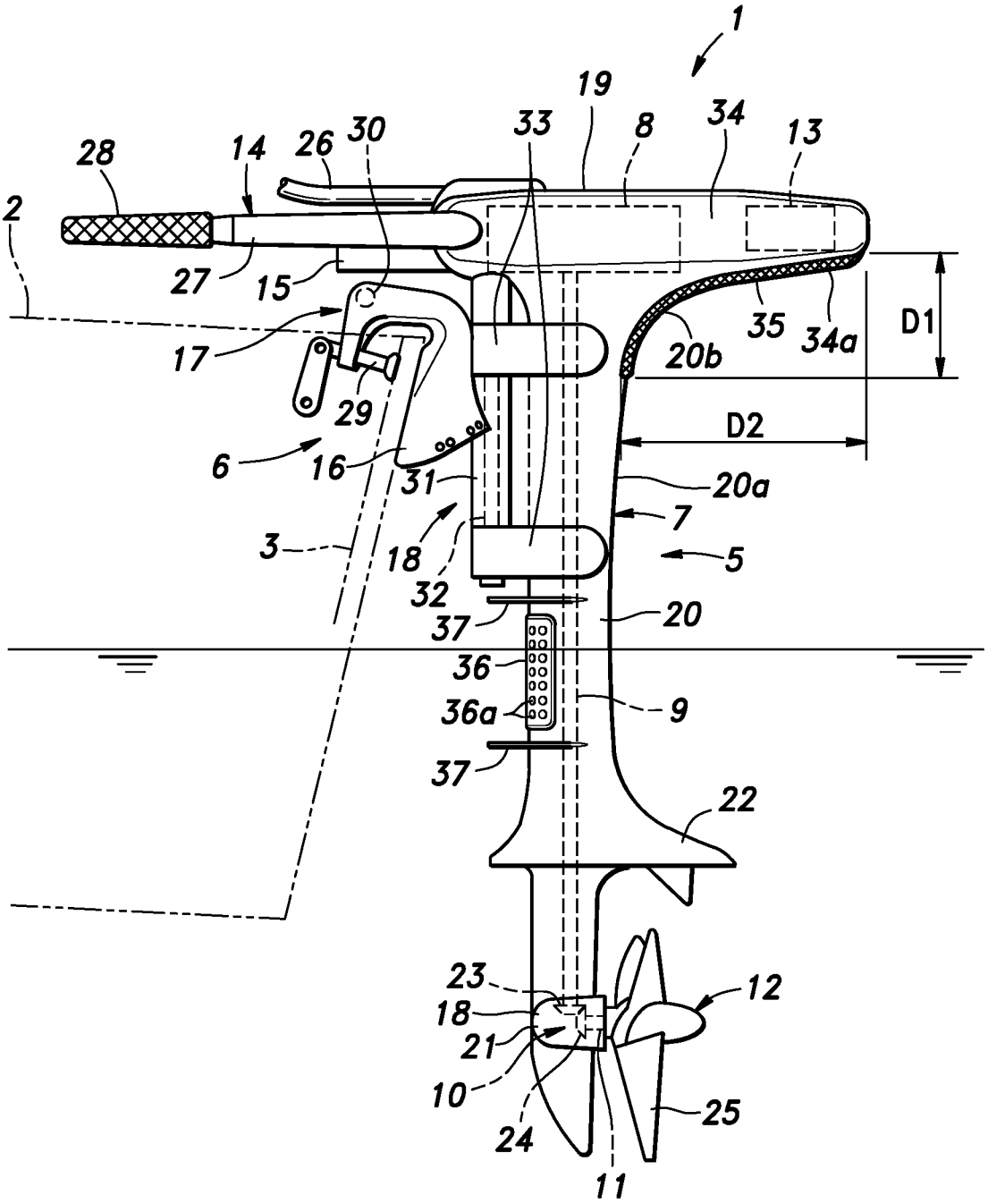
FIG. 1 is a side view of an electric outboard motor according to an embodiment of the present invention.
Figure 2:
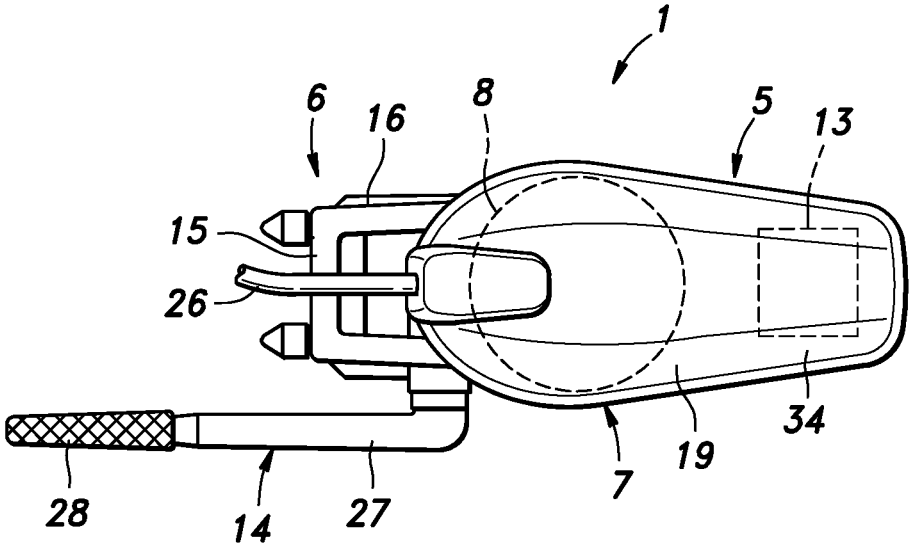
FIG. 2 is a plan view of the electric outboard motor.

FIG. 1 is a side view of the electric outboard motor 1 and FIG. 2 is a plan view of the electric outboard motor 1. As shown in FIGS. 1 and 2, to propel the hull 2 according to an operation by an occupant (operator), the electric outboard motor 1 is detachably mounted to the tail of the hull 2, specifically, to a transom board 3. The electric outboard motor 1 is driven by electric power supplied from a battery (not shown in the drawings) installed in the hull 2.

The electric outboard motor 1 includes an outboard motor main body 5 and a mounting device 6 for mounting the outboard motor main body 5 to the hull 2. The outboard motor main body 5 includes a main body case 7, an electric motor 8, a drive shaft 9, a gear device 10, a propeller shaft 11, a propeller 12, a control device 13, an input device 14, and a handle 15. The mounting device 6 includes a clamp bracket 16, a tilt mechanism 17, and a swivel mechanism 18. In the following, these components of the electric outboard motor 1 will be described.

The main body case 7 is made of a metallic material or a rigid resin material to have a predetermined stiffness. The main body case 7 includes a case upper portion 19 disposed in an upper portion and a case lower portion 20 disposed below the case upper portion 19. The case upper portion 19 and the case lower portion 20 may be made of the same material or may be made of mutually different materials. The case upper portion 19 has a hollow shape that is flat in the up-down direction and elongated in the front-rear direction. The case upper portion 19 houses the electric motor 8 and the control device 13. The case lower portion 20 has a hollow shape elongated in the up-down direction. The case lower portion 20 houses the drive shaft 9 and the gear device 10.

A lower portion of the case lower portion 20 is integrally provided with a gear case 21 accommodating the gear device 10, and an anti-ventilation plate 22 is integrally provided above the gear case 21. The gear case 21 has a bullet shape that is elongated in the front-rear direction and swells laterally relative to the case lower portion 20. The anti-ventilation plate 22 has a plate shape extending in the horizontal direction and extends out rearward to cover the propeller 12 from above.

The electric motor 8 is a power source for rotating the propeller 12 and may be a permanent magnet synchronous motor, for example. The electric motor 8 is disposed in a front portion of the case upper portion 19 such that the output shaft thereof extends vertically downward. In this posture, the electric motor 8 is formed in a flat shape having a horizontal dimension greater than s height dimension.

The drive shaft 9 extends in the up-down direction below the electric motor 8. The upper end portion of the drive shaft 9 is connected to the output shaft of the electric motor 8. The lower end portion of the drive shaft 9 is integrally provided with a drive gear 23 consisting of a first bevel gear. The drive shaft 9 is rotatably supported by a pair of upper and lower bearings in the case lower portion 20.

The propeller shaft 11 extends in the front-rear direction (horizontal direction) below the drive shaft 9. Namely, the axial direction of the propeller shaft 11 coincides with the front-rear direction. The front portion of the propeller shaft 11 is accommodated in the gear case 21 and is rotatably supported by a pair of front and rear bearings in the gear case 21. The front end portion of the propeller shaft 11 is integrally provided with a driven gear 24 consisting of a second bevel gear and meshing with the drive gear 23. The propeller shaft 11 penetrates through a support hole of the gear case 21 and extends rearward from the gear case 21 to be exposed to the outside of the main body case 7.

The gear device 10 is configured to include the drive gear 23 provided at the lower end of the drive shaft 9 and the driven gear 24 provided at the front end of the propeller shaft 11. Rotation of the drive shaft 9 is transmitted to the propeller shaft 11 via the gear device 10.

The propeller 12 is fixed to the outer circumference of a rear portion of the propeller shaft 11. The propeller 12 is positioned more rearward than the rear end portion of the gear case 21 and is exposed to the outside of the main body case 7. The outer circumferential surface of the propeller 12 is provided with multiple fins 25 radially protruding therefrom.

The control device 13 is constituted of a power control unit (PCU). The control device 13 is connected to the battery provided in the hull 2 via a cable 26. Also, the control device 13 is connected to the input device 14. According to an operation signal inputted from the input device 14, the control device 13 supplies electric power to the electric motor 8 and controls the operation of the propeller 12.

The input device 14 is a device for receiving an input operation performed by the occupant and is integrally provided on the case upper portion 19 of the outboard motor main body. In the present embodiment, the input device 14 includes a tiller handle 27 provided on the case upper portion 19 to be pivotable about a laterally extending axis and a throttle grip 28 provided at the free end of the tiller handle 27. The tiller handle 27 is disposed in a position to protrude forward during operation. When stowed, the tiller handle 27 is pivoted rearward to a position to extend along the case upper portion 19.

When the throttle grip 28 is rotated in one direction, the control device 13 supplies electric power to the electric motor 8 to rotate the propeller 12 in a forward movement direction with a torque corresponding to the amount of rotation. When the throttle grip 28 is rotated in the other direction, the control device 13 supplies electric power to the electric motor 8 to rotate the propeller 12 in a backward movement direction with a torque corresponding to the amount of rotation.

The handle 15 is integrally provided on the case upper portion 19 to protrude forward from the front portion of the case upper portion 19. The handle 15 is provided such that when the electric outboard motor 1 is attached to or detached from the hull 2, the electric outboard motor 1 can be held stably. The handle 15 has a substantially rectangular annular shape in plan view (FIG. 2).

The clamp bracket 16 is a bracket for fixing the outboard motor main body 5 to the hull 2 and rotatably holds a pair of left and right clamp bolts 29 in the front portion thereof. The clamp bracket 16 rotatably supports a laterally extending tilt shaft 30 in a front upper portion thereof and constitutes a part of the tilt mechanism 17. The electric outboard motor 1 is detachably mounted to the hull 2 by the clamp bracket 16.

The tilt mechanism 17 is a mechanism for rotating the outboard motor main body 5 relative to the clamp bracket 16 with the tilt shaft 30 being a rotational center. The tilt mechanism 17 includes a swivel bracket 31 rotatably supported on the clamp bracket 16 via the tilt shaft 30. The swivel bracket 31 rotatably holds a swivel shaft 32 that extends in the vertical direction. The electric outboard motor 1 is mounted to the hull 2 to be pivotable up and down about the tilt shaft 30.

The swivel mechanism 18 is a mechanism for rotating the outboard motor main body 5 relative to the swivel bracket 31 with the swivel shaft 32 being a rotational center. The swivel mechanism 18 includes, in addition to the swivel shaft 32, a pair of upper and lower shaft supports 33 integrally provided on the main body case 7 to support the upper and lower ends of the swivel shaft 32. The electric outboard motor 1 is mounted to the hull 2 to be pivotable left and right about the swivel shaft 32.

The case upper portion 19 is larger in size than the case lower portion 20 in plan view and protrudes from the upper end of the case lower portion 20 in a radial direction over the entirety in the circumferential direction. An amount of radial protrusion of the case upper portion 19 from the upper end of the case lower portion 20 is the largest in the rear portion. Namely, the case upper portion 19 extends relative to the case lower portion 20 more in the rearward direction than in the other directions. In the following, the part of the case upper portion 19 extending rearward relative to the case lower portion 20 will be referred to as a rearward extension 34.

The upper end portion of the case lower portion 20 diverges in the upward direction and is smoothly connected to the case upper portion 19. Namely, a rear surface 20*a* of the case lower portion 20 and a lower surface 34*a* of the rearward extension 34 are smoothly connected to each other via the curved surface 20*b*.

The lower surface 34*a* of the rearward extension 34 of the case upper portion 19 is provided with a shoulder pad member 35 which is a member separate from the case upper portion 19. The shoulder pad member 35 is made of a material having an elastic modulus smaller than that of the material of the case upper portion 19. The shoulder pad member 35 may be made of natural rubber, synthetic rubber, silicone rubber, fluorine rubber, urethane rubber or the like, for example. The shoulder pad member 35 is made of a strip-shaped sheet material having a dimension in the front-rear direction longer than a direction in the width dimension, and is joined to the main body case 7 by appropriate joining means such as an adhesive or snap fit.

The shoulder pad member 35 is provided to extend from the lower surface 34*a* of the rearward extension 34 to the rear surface 20*a* of the case lower portion 20 via the curved surface 20*b*. Also, the shoulder pad member 35 extends from the curved surface 20*b* side to the rear end of the rearward extension 34. The shoulder pad member 35 also extends in the up-down direction but extends more in the front-rear direction. Namely, the shoulder pad member 35 extends over a first dimension D1 in the up-down direction and extends over a second dimension D2 that is greater than the first dimension D1 in the front-rear direction.

At an intermediate portion of the case lower portion 20 in the up-down direction, specifically, at a portion between the swivel mechanism 18 and the anti-ventilation plate 22, a grasping member 36 which is a member separate from the case lower portion 20 is provided. The grasping member 36 is made of a material having an elastic modulus smaller than that of the material of the case lower portion 20. The grasping member 36 may be made of natural rubber, synthetic rubber, silicone rubber, fluorine rubber, urethane rubber or the like, for example.

The case lower portion 20 has an elliptical, flat cross-sectional shape. The grasping member 36 is made of a sheet material and is provided to be in an arc shape convex forward and to cover a front portion of the case lower portion 20. In another embodiment, the grasping member 36 may be provided to cover a rear portion of the case lower portion 20 or to cover the entire circumference of the case lower portion 20. A surface (an outer surface with an arc-shaped cross section) of the grasping member 36 has irregularities 36*a* formed thereon. The grasping member 36 is joined to the main body case 7 by appropriate joining means such as an adhesive or snap fit.

The grasping member 36 is disposed in a position spaced from the swivel mechanism 18 and the anti-ventilation plate 22. At parts of the case lower portion 20 above and below the grasping member 36, specifically, at the part between the grasping member 36 and the swivel mechanism 18 and at the part between the grasping member 36 and the anti-ventilation plate 22, arc-shaped protruding portions 37 that protrude forward are integrally formed.

The electric outboard motor 1 is configured as described above. Next, a mode of transport of the electric outboard motor 1 will be described with reference to FIGS. 3 and 4.

Figure 3:
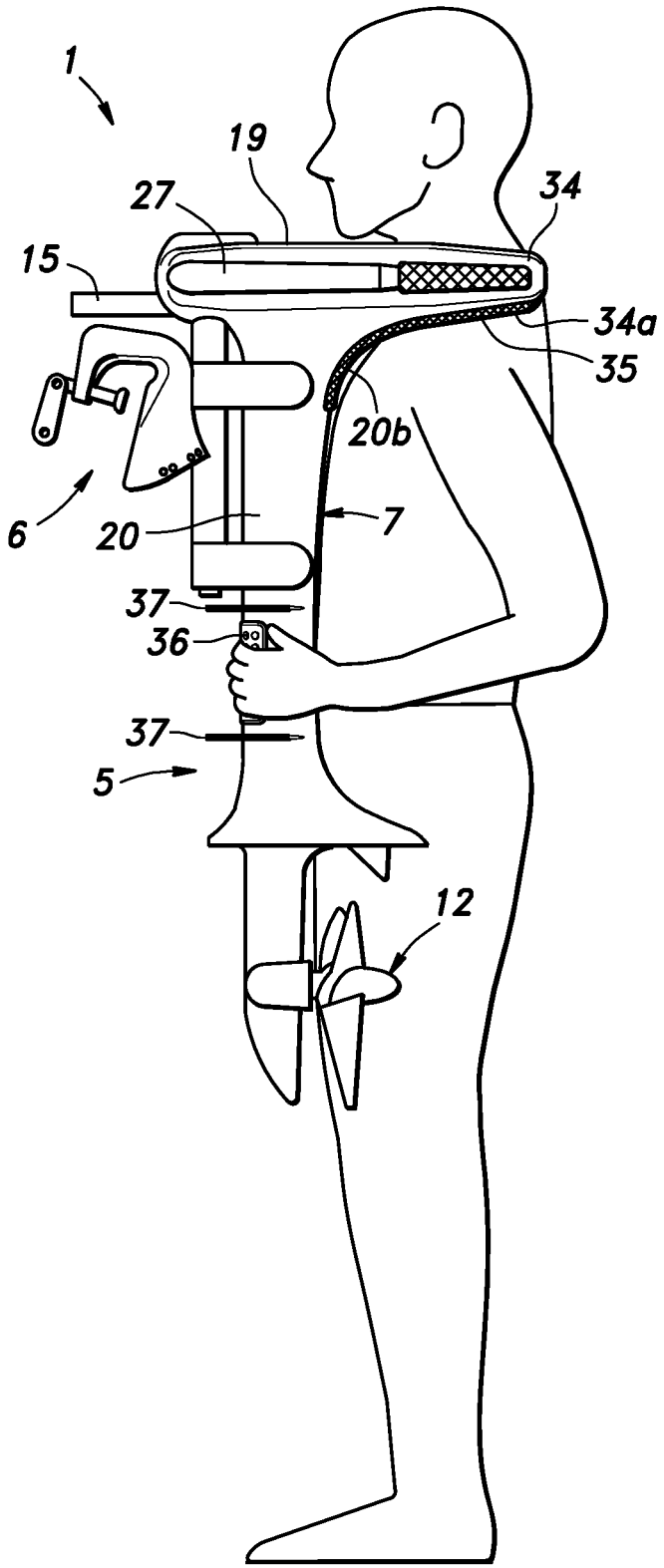
FIG. 3 is a side view showing the electric outboard motor in a transport state.
Figure 4:
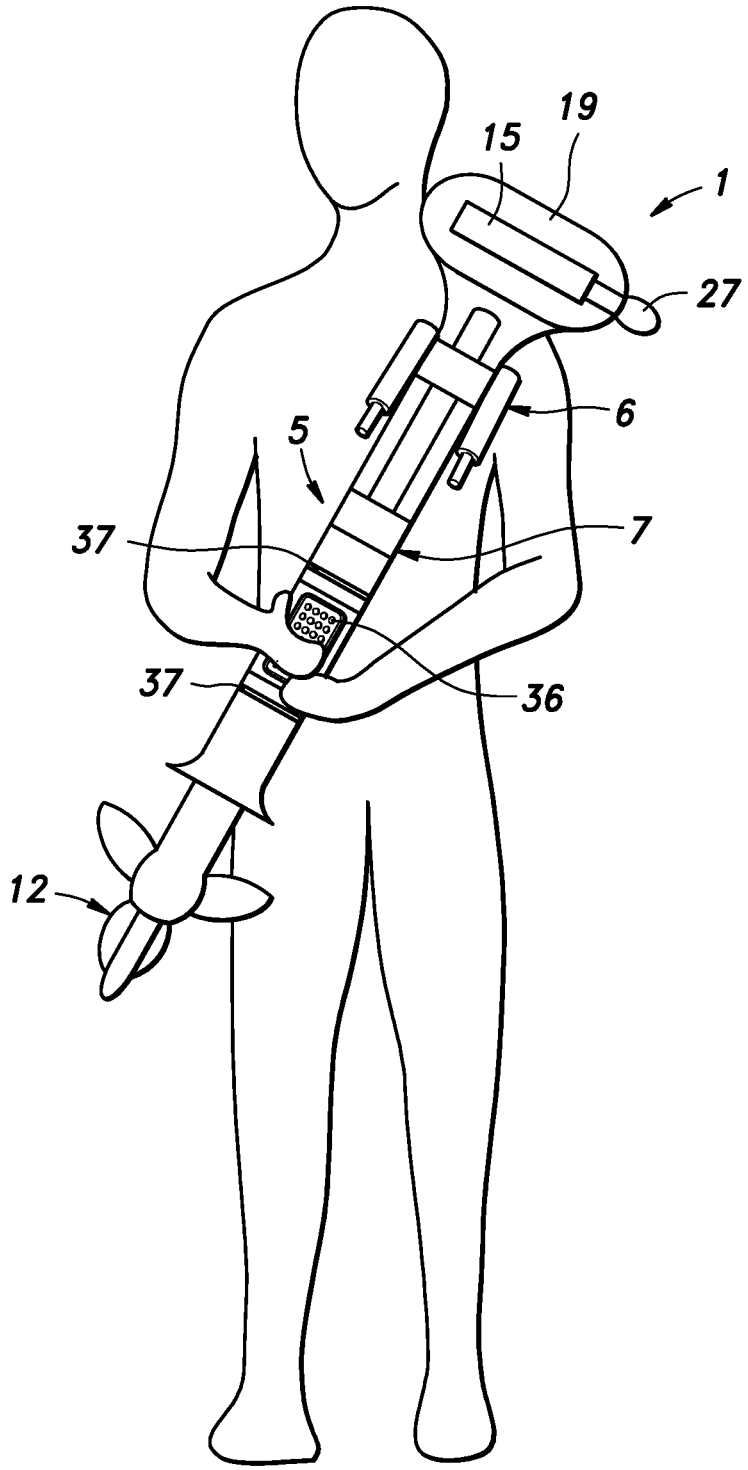
FIG. 4 is a front view showing the electric outboard motor in the transport state.

FIGS. 3 and 4 are a side view and a front view, respectively, showing the electric outboard motor 1 in the transport state. As shown in FIGS. 3 and 4, the electric outboard motor 1 may be detached from the hull 2 after the sailing ends, and then, may be transported to the storage location to be stored in the storage location. The electric outboard motor 1 stored in the storage location is transported to be mounted to the hull 2 when the sailing starts.

As described above, the case upper portion 19 has the rearward extension 34. Therefore, as shown in FIG. 3 or 4, when transporting the electric outboard motor 1, the user can place the rearward extension 34 on the shoulder such that the case lower portion 20 is positioned in front of the body of the user. Preferably, the user grasps the grasping member 36 and makes the case lower portion 20 contact the front side of the body. By lifting the electric outboard motor 1 in this way, the user does not have to support the load of the electric outboard motor 1 with hands. In other words, the muscle strength of the arms and hands required for transport of the electric outboard motor 1 is reduced. Therefore, a person with a weak grip can transport the electric outboard motor 1 easily, and the transportability of the electric outboard motor 1 is improved.

Note that, as shown in FIG. 3, the electric outboard motor 1 may be lifted and transported in a posture in which the case lower portion 20 extends vertically, namely, the propeller 12 is positioned below the shoulder on which the case upper portion 19 is placed. Alternatively, as shown in FIG. 4, the electric outboard motor 1 may be lifted and transported in a posture in which the case lower portion 20 extends diagonally in front of the body of the user, namely, the propeller 12 is placed below the shoulder on the side opposite from the shoulder on which the case upper portion 19 is placed.

Next, operations and effects of the electric outboard motor 1 according to the embodiment will be described.

As shown in FIG. 1, in the present embodiment, the shoulder pad member 35, which is a member separate from the main body case 7 is provided on the lower surface 34*a* of the rearward extension 34 of the case upper portion 19. Thereby, when transporting the electric outboard motor 1, the user can lift the electric outboard motor 1 by placing the case upper portion 19 on the shoulder such that the shoulder pad member 35 contacts the shoulder. Therefore, even if the user has a weak grip, the user can transport the electric outboard motor 1 easily.

Since the shoulder pad member 35 has an elastic modulus smaller than that of the case upper portion 19, the shoulder hurts less while the user is lifting the electric outboard motor 1.

The rear surface 20*a* of the case lower portion 20 and the lower surface 34*a* of the rearward extension 34 are connected to each other via the curved surface 20*b*, and the shoulder pad member 35 is provided to extend from the lower surface 34*a* of the rearward extension 34 to the curved surface 20*b*. Therefore, when the electric outboard motor 1 is swayed while the user is lifting the electric outboard motor 1, an impact applied from the electric outboard motor 1 to the user is reduced.

The shoulder pad member 35 extends over a first dimension D1 in the up-down direction and extends over a second dimension D2 that is greater than the first dimension D1 in the front-rear direction. Namely, the shoulder pad member 35 is longer in the front-rear direction than in the up-down direction. Therefore, it is easy for the user to carry the electric outboard motor 1 on the shoulder.

The shoulder pad member 35 extends to the rear end of the rearward extension 34. Thereby, even if the electric outboard motor 1 slides forward while the user is carrying the electric outboard motor 1 on the shoulder, the case upper portion 19 is prevented from being directly placed on the shoulder. Therefore, the user can lift the electric outboard motor 1 stably.

The grasping member 36, which is a member separate from the main body case 7, is provided on a part of the case lower portion 20 spaced downward from the case upper portion 19. Thereby, when transporting the electric outboard motor 1, the user can grasp the grasping member 36 with a hand. Therefore, the user can lift the electric outboard motor 1 stably.

The grasping member 36 has an elastic modulus smaller than that of the case lower portion 20. Thereby, it is easy for the user to grasp the grasping member 36. Also, the hand grasping the grasping member 36 does not slip easily. Therefore, the user can lift the electric outboard motor 1 stably.

The grasping member 36 is made of a sheet material provided along the outer surface of the case lower portion 20 and has a surface formed with irregularities 36*a*. Thereby, the hand grasping the grasping member 36 does not slip easily. Therefore, the user can lift the electric outboard motor 1 stably.

The case lower portion 20 has at least one of the protruding portions 37 that protrude in the horizontal direction above and below the grasping member 36. Thereby, the user can easily recognize the position of the grasping member 36. Also, if the hand grasping the grasping member 36 slips, the hand is prevented from leaving from the grasping member 36.

A concrete embodiment of the present invention has been described in the foregoing, but the present invention is not limited to the above embodiment and may be modified or altered in various ways. For example, in the above embodiment, the case upper portion 19 houses the electric motor 8 and the control device 13 but the control device 13 may be provided outside the outboard motor main body 5. The shoulder pad member 35 and the grasping member 36 are only required to be members separate from the main body case 7 and may be made of the same material as the material of the main body case 7. Besides, the concrete structure, arrangement, number, material, angle, etc. of each member or part described in the above embodiment may be appropriately changed without departing from the spirit of the present invention. Also, not all of the components shown in the foregoing embodiment are necessarily indispensable and they may be selectively adopted as appropriate.

The invention claimed is:

1. An electric outboard motor, comprising:

an electric motor disposed in an upper portion;

a propeller disposed in a lower portion;

a drive shaft extending in an up-down direction to transmit rotation of the electric motor to the propeller;

a case including a case upper portion that houses the electric motor and a case lower portion that houses the drive shaft; and a mounting device for mounting the case to a hull, wherein the case upper portion includes a rearward extension that extends rearward relative to the case lower portion, and a shoulder pad member which is a member separate from the case is provided on a lower surface of the rearward extension, and wherein a grasping member which is a member separate from the case is provided on a front part of the case lower portion spaced downward from the case upper portion, the front part being below the mounting device.

2. The electric outboard motor according to claim 1, wherein the shoulder pad member has an elastic modulus smaller than that of the case.

3. The electric outboard motor according to claim 1, wherein the lower surface of the rearward extension is connected to a rear surface of the case lower portion via a curved surface, and the shoulder pad member is provided to extend from the lower surface to the curved surface.

4. The electric outboard motor according to claim 3, wherein the shoulder pad member extends over a first dimension in the up-down direction and extends over a second dimension greater than the first dimension in a front-rear direction.

5. The electric outboard motor according to claim 4, wherein the shoulder pad member extends to a rear end of the rearward extension.

6. The electric outboard motor according to claim 1, wherein the grasping member has an elastic modulus smaller than that of the case.

7. The electric outboard motor according to claim 1, wherein the grasping member is made of a sheet material provided along an outer surface of the case lower portion and has a surface formed with irregularities.

8. The electric outboard motor according to claim 7, wherein the case lower portion has at least one of protruding portions that protrude in a horizontal direction above and below the grasping member, respectively.

* * * * *